US011167192B2

(12) United States Patent
Suzuki

(10) Patent No.: US 11,167,192 B2
(45) Date of Patent: Nov. 9, 2021

(54) GOLF SWING TRAINING TOOL

(71) Applicant: Susumu Suzuki, Kanagawa (JP)

(72) Inventor: Susumu Suzuki, Kanagawa (JP)

( * ) Notice: Subject to any disclaimer, the term of this patent is extended or adjusted under 35 U.S.C. 154(b) by 53 days.

(21) Appl. No.: 16/894,325

(22) Filed: Jun. 5, 2020

(65) Prior Publication Data

US 2020/0298086 A1 Sep. 24, 2020

Related U.S. Application Data

(63) Continuation of application No. PCT/JP2018/006299, filed on Feb. 21, 2018.

(30) Foreign Application Priority Data

Dec. 11, 2017 (JP) ..... JP2017-236611

(51) Int. Cl.
*A63B 69/36* (2006.01)
*A63B 102/32* (2015.01)

(52) U.S. Cl.
CPC ..... *A63B 69/3632* (2013.01); *A63B 69/3623* (2013.01); *A63B 2102/32* (2015.10); *A63B 2209/02* (2013.01)

(58) Field of Classification Search
CPC ..... A63B 69/36; A63B 69/3632; A63B 69/38; A63B 69/00; A63B 69/0002; A63B 2069/0008; A63B 69/0015; A63B 69/0017; A63B 69/0024; A63B 21/06; A63B 21/0601; A63B 21/0604; A63B 69/3623; A63B 2012/32; A63B 2209/02
See application file for complete search history.

(56) References Cited

U.S. PATENT DOCUMENTS 4,029,312 A * 6/1977 Wright ..... A63B 21/0602 482/108
5,080,349 A * 1/1992 Vittone ..... A63B 23/14 482/106
5,215,307 A * 6/1993 Huffman ..... A63B 15/00 473/256
5,851,156 A 12/1998 Schwark, Jr.
6,022,278 A * 2/2000 Vela ..... A63B 53/14 473/201

(Continued)

FOREIGN PATENT DOCUMENTS

CA 3037761 A1 * 2/2018 ..... A63B 21/072
JP 3011144 U 5/1995
JP 2012-016554 A 1/2012

OTHER PUBLICATIONS

International Search Report issued in PCT/JP2018/006299 dated Mar. 20, 2018 with English Translation (3 pages).

*Primary Examiner* — Raleigh W Chiu
(74) *Attorney, Agent, or Firm* — Nakanishi IP Associates, LLC

(57) ABSTRACT

A small golf swing training tool has the same weight balance as that of a golf club and can easily confirm the orientation of the club face during training. A golf swing training tool includes a grasping part made of a rod-shaped member, a weight part made of a plate-like (plate-shaped) member surrounding both ends of the grasping part, and an insertion hole required to allow to grasp the grasping part between the grasping part and the weight part. The grasping part is not arranged at the weight center of the weight part.

8 Claims, 8 Drawing Sheets

(56) References Cited

U.S. PATENT DOCUMENTS

| | | | | |
|---|---|---|---|---|
| 7,553,239 | B2 * | 6/2009 | Pullaro | A63B 15/00 473/256 |
| 8,894,503 | B2 * | 11/2014 | Dandrea | A63B 69/3632 473/226 |
| 9,364,734 | B1 * | 6/2016 | Dixon, Jr. | A63B 71/0622 |
| 9,555,303 | B1 * | 1/2017 | Novosel, Sr. | A63B 15/00 |
| 2002/0160849 | A1 * | 10/2002 | Thomas | A63B 60/02 473/251 |
| 2004/0082400 | A1 * | 4/2004 | Yoshimura | A63B 69/0059 473/276 |
| 2005/0003931 | A1 * | 1/2005 | Mills | A63B 21/0601 482/5 |
| 2006/0073951 | A1 * | 4/2006 | Walkow | A63B 21/072 482/109 |
| 2009/0143158 | A1 * | 6/2009 | Fidge | A63B 69/3685 473/238 |
| 2014/0066220 | A1 * | 3/2014 | Dandrea | A63B 69/0057 473/227 |
| 2016/0144220 | A1 * | 5/2016 | Wood | A63B 21/4035 482/93 |
| 2017/0120104 | A1 * | 5/2017 | Douglass | A63B 21/015 |
| 2017/0136283 | A1 * | 5/2017 | Sorin | A63B 21/4035 |
| 2019/0054336 | A1 * | 2/2019 | Wang | A63B 21/0601 |
| 2019/0168060 | A1 * | 6/2019 | Laurence | A63B 21/4035 |

* cited by examiner

GOLF SWING TRAINING TOOL

CROSS-REFERENCE TO RELATED APPLICATIONS

This application is a continuation application of International Patent Application No. PCT/JP2018/6299 filed on Feb. 21, 2018, which is based upon and claims the benefit of priority from the prior Japanese Patent Application No. 2017-236611, filed Dec. 11, 2017 the entire contents of which are incorporated herein by reference.

FIELD

The present invention relates to a training tool used for training a golf swing, and particularly, to a golf swing training tool capable of safely training a golf swing in conformity with the golf theory even in a small space such as indoors.

BACKGROUND

A novice golfer who wants to improve his/her skills needs to master the basic golf swing first. Furthermore, in order to become an intermediate player or an advanced player, a practical golf swing adapted to his/her own physical fitness and course condition is required, in addition to the basic golf swing.

An efficient training method in conformity with the golf theory is required to master various golf swings. Specifically, it is important to carry out training while being strongly aware of the orientation of the club face and the swing trajectory.

Conventionally, the golf club used for the actual round (hereinafter referred to as a "golf club") is generally used when training the golf swing. However, there is a problem that it is difficult for a golfer to determine the orientation of the club face located at the tip of the shaft during the swing when the golf club is used, and a problem that the indoor training is difficult since the swing trajectory is large and a certain space is required.

With respect to such a problem, Patent Document 1 discloses a golf training tool (golf swing training tool) which is integrally configured in a state where a first shaft body provided with a (first) grip part on one end side and a second shaft body provided with a (second) grip part on one end side are disposed nearly parallel to each other at a prescribed interval, and positions of the respective (first) (second) grip parts are relatively displaced between the first shaft body and the second shaft body such that the (first) grip part is positioned on the nearer side than the (second) grip part.

PRIOR ART DOCUMENT

Patent Document

Patent Document 1: JP2012-16554A

BRIEF DESCRIPTION OF THE INVENTION

However, the golf swing training tool described in Patent Document 1 has a problem in that the golfer feels uncomfortable since the grip part is different from the golf club and the weight balance with respect to the grip part is different from that in the golf club.

The object of the present invention is to provide a small golf swing training tool which has approximately the same weight balance as using a golf club and is capable of easily confirming the orientation of a club face during training.

The present invention is devised to achieve such an object. Specifically, the present invention includes a golf swing training tool which comprises a grasping part made of a rod-shaped member, a weight part made of a plate-like (plate-shaped) member surrounding both ends of the grasping part, and an insertion hole required to allow grasping the grasping part between the grasping part and the weight part, wherein the grasping part is configured by a hollow tubular shaft part and a grip part which covers the shaft part, both ends of the shaft part are embedded at required positions at a substantially central part in a thickness direction of an inner wall of the insertion hole, and the weight part is configured in such a manner that the weight of a part above the grasping part is larger than that of a part below the grasping part in the state of grasping the grasping part.

The golf swing training tool of the present invention can be used for indoor training safely since it is smaller and has a smaller swing trajectory as compared with the golf club. Furthermore, the golf swing training tool has an effect that a golfer can have the actual swing feeling since it has a weight balance approximately the same as that of the golf club.

The present invention includes a configuration wherein an upper surface portion (thickness portion) of the weight part is arranged at a position indicating the orientation of the club face, and the upper surface portion (thickness portion) has an indication which can be visually recognized.

According to the golf swing training tool of the present invention, when the golfer holds the grasping part with both hands for training, he/she can distinguish the orientation of the club face according to the indication on the upper surface portion (thickness portion) of the weight part, and thus it is possible to visually confirm the orientation of the club face at the hand in each step of the swing.

In the present invention, the grasping part is detachably arranged at a substantially central part in a thickness direction of an inner wall of the weight part, and the grasping part includes a hollow tubular shaft part made of metal or fiber reinforced resin, and a stretchable and detachable grip part covering the shaft part and made of an elastic material.

In the golf swing training tool of the present invention, a new grip part can be easily changed when the grip part is soiled with sweat or hardened on its surface, and furthermore, the grip part can be selectively replaced with a grip part according to a golfer's preference.

The present invention includes a configuration wherein two single-handed units each to be grasped by single hand are continuously provided in series at a required interval regarding the grasping part and the weight part.

The golf swing training tool of the present invention has an effect that the training can be carried out while the turning of the hand can be more recognized during the golf swing by setting the positions to be grasped by two hands slightly apart from each other with respect to the golf club.

The present invention includes a configuration wherein the single-handed units are detachably connected to each other.

The golf swing training tool of the present invention has an effect that the golf swing can be confirmed with the right hand and the left hand alone since the single-handed unit can be used alone.

The present invention includes a configuration wherein the weight part is made of a flat plate member which is an elastic material such as rubber or elastomer.

Since both ends of the grasping part of the golf swing training tool of the present invention are covered with the elastic material, the golfer can train with confidence the drastic downswing such as brining the grasping part close to his/her own body since he/she does not have to worry about hitting of the hard grasping part against his/her own body during the training of the golf swing.

The present invention includes a configuration wherein the weight part includes a material having a specific gravity different from that of rubber or elastomer, such as iron or non-ferrous metal.

The golf swing training tool of the present invention can be expected to have an effect of adjusting the balance distribution in materials having different specific gravities as an adjusting member for approximating the weight balance approximately the same as that of the golf club.

When the golf swing training tool of the present invention is used, there is an effect that the golfer can have the swing feeling indoors like the use of a golf club, and the orientation of the club face can be visually confirmed during the golf swing.

DETAILED DESCRIPTION OF THE INVENTION

Hereinafter, the embodiments of the present invention will be described with reference to the accompanying drawings. However, the drawings are shown schematically and do not necessarily match the actual dimensions, ratios or the like. Between the drawings, parts having different dimensional relationships and ratios may be included.

In addition, in the present embodiment, the golfer side is referred to as the upper side and the opposite side is referred to as the lower side in a state where the golfer holds the golf swing training tool.

First Embodiment

Figure 1:
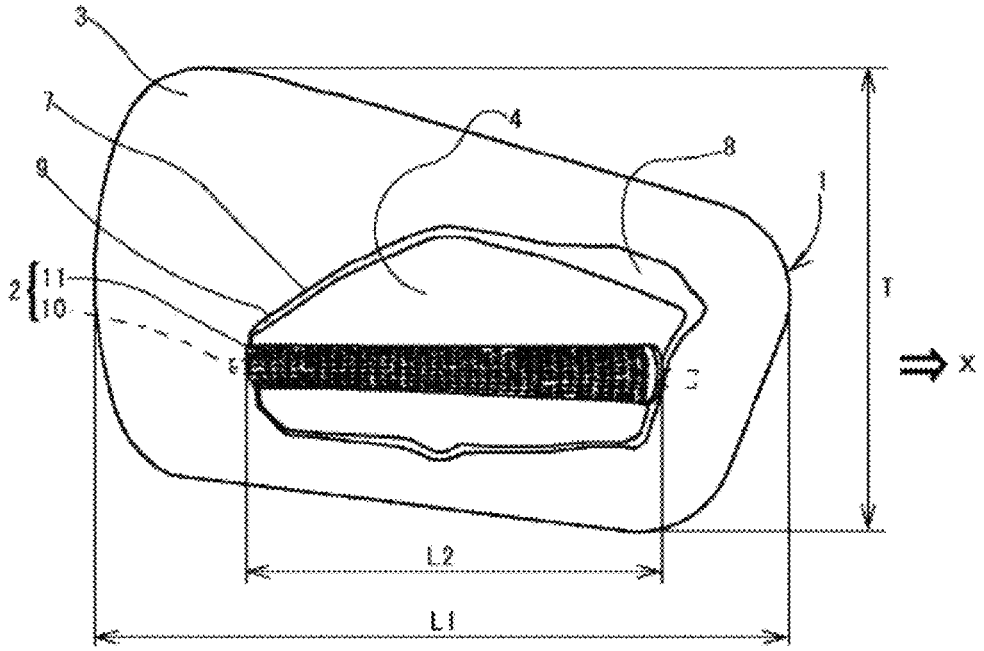
FIG. 1 is a front view illustrating a golf swing training tool according to a first embodiment of the present invention.
Figure 5:
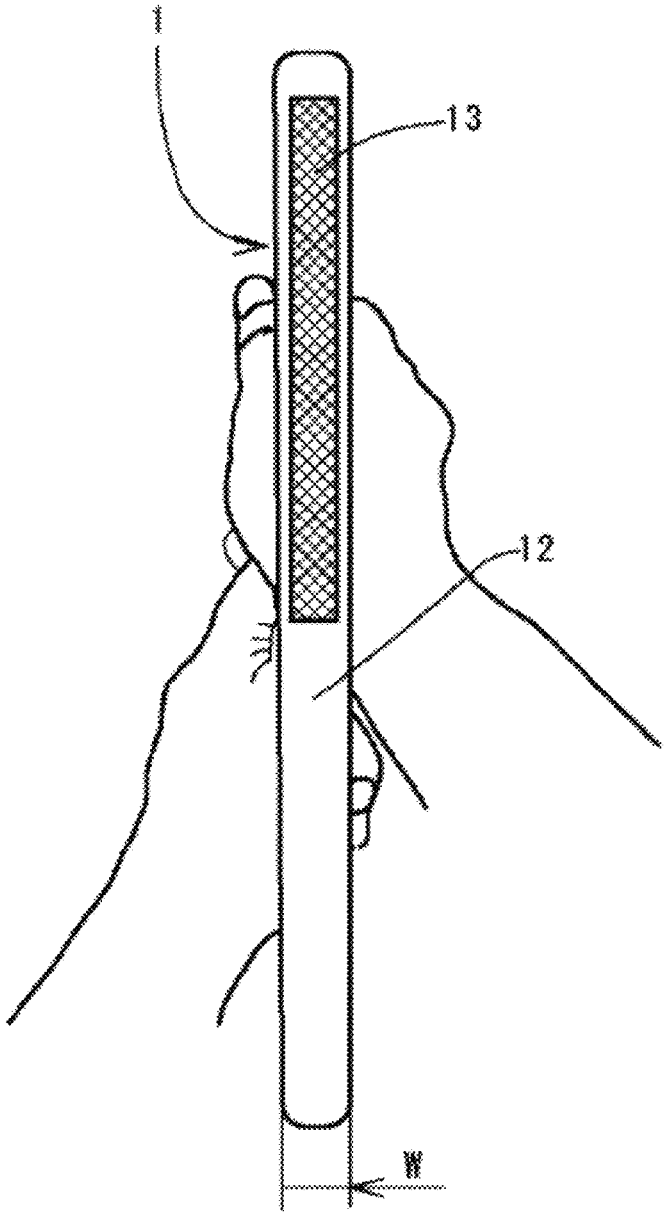
FIG. 5 is a plan view illustrating a usage state of the golf swing training tool according to FIG. 1.

As shown in FIGS. 1 and 5, a golf swing training tool 1 according to the present embodiment includes a grasping part 2 made of a rod-shaped member, and a weight part 3 made of an elastic plate-shaped member surrounding the grasping part 2, and an insertion hole 4 formed in a gap between the grasping part 2 and the weight part 3 to allow a golfer to insert his/her hand.

Furthermore, the weight part 3 is formed by chamfering in a curved manner four corners of a plate-shaped member having a substantially rectangular shape in a front view, and the insertion hole 4 forms a required gap which allows the golfer to insert his/her two hands, and a border part 8 for avoiding a wrist or the like is formed on an inner peripheral edge 7 thereof.

Furthermore, the grasping part 2 is detachably inserted at a substantially central part in the thickness direction of the inner wall 9 of the insertion hole 4. The grasping part 2 is formed by a hollow tubular shaft part 10 made of metal or fiber reinforced resin, and a stretchable and detachable grip part 11 made of an elastic material such as rubber or elastomer to cover the shaft part 10.

The grasping part 2 is mounted by providing mounting holes (not shown) slightly smaller than the outer diameter of the shaft part 10 at required positions on the front and rear sides of the inner wall 9, and when both ends of the shaft part 10 are inserted and embedded, holding the shaft part 10 by a restoring force of the weight part 3 since the weight part 3 is made of the elastic material, and preventing the movement of the shaft part 10 in the front-rear direction with the grip part 11 to fix it.

The weight part 3 has such a weight that a part above the grasping part 3 is heavier than a part below the grasping part 3 in a state where the golfer holds the golf swing training tool 1. Furthermore, the weight part 3 is arranged at a position indicating the direction of the club face, and an indication part 13 which is colored to be visually recognizable is formed on the upper surface portion 12 thereof.

An elastic material such as rubber or elastomer may be used as the material of the weight part 3, and the manufacturing method in that case may include molding by cutting the material such as a rubber plate or manufacturing by being integrally molded with a press molding with a die or an injection molding.

Next, a method of using the golf swing training tool 1 according to the present embodiment will be described.

Figure 8:
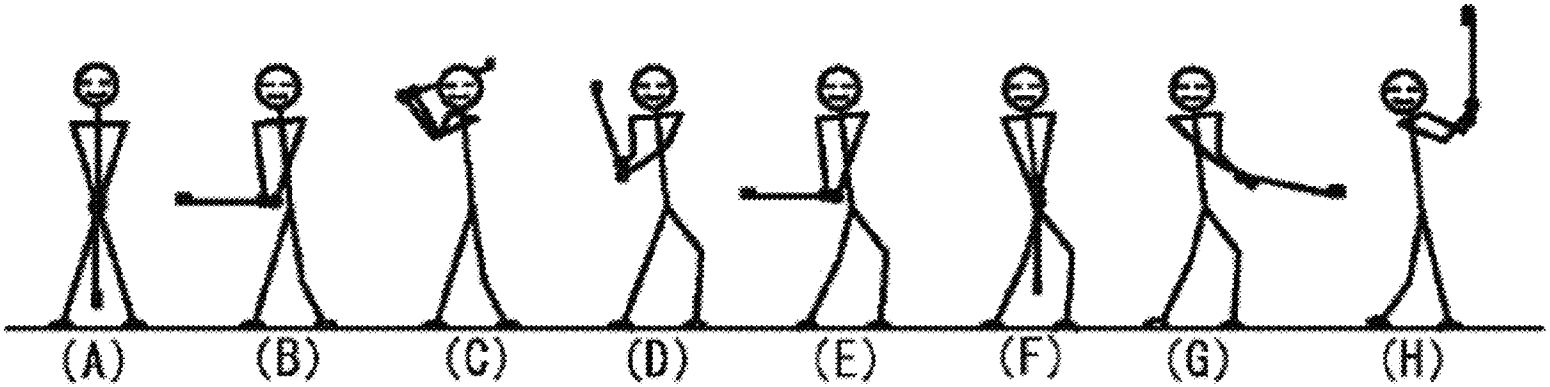
FIG. 8 is a diagram illustrating a change state of a basic golf swing.

FIG. 8 shows the change in the state of the basic golf swing in order, changing from the address (A), then the halfway back (B) and the top (C) after entering the backswing, and then the downswing (D) (E), the impact (F), the follow through (G) and the finish (H).

Here, when using the golf swing training tool 1 according to the present embodiment, first, as shown in FIG. 5, the golfer grasps the grip part 11 with the left and right hands from both sides of the weight part 3 for address. At that time, the golf swing is started while assuming the position of the indication part 13 as the orientation of the club face. In this way, it is possible to carry out training while visually confirming the orientation of the club face in any state of the golf swing.

Figure 10:
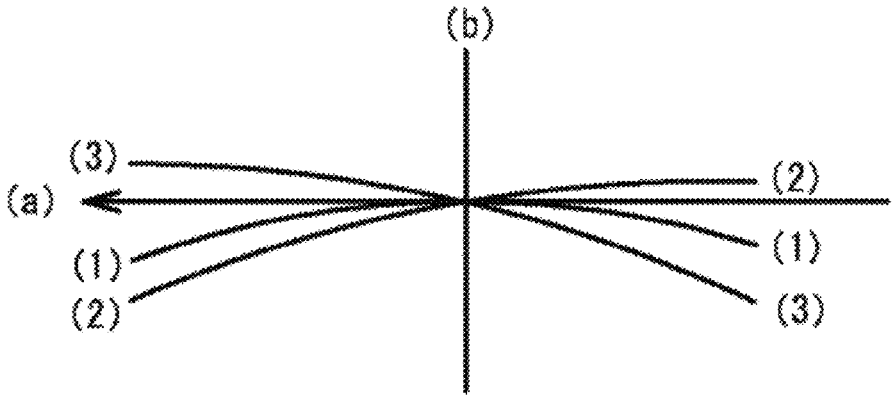
FIG. 10 is a diagram illustrating a club head trajectory in a plan view.

The golf swing is based on the inside-in (1) in the club head trajectory in a plan view shown in FIG. 10. The inside-in (1) means that the club enters from the interior through the downswing with respect to a flight direction (a), and exits to the interior after passing through the impact point (b), and furthermore, the orientation of the club face at the impact point (b) at that time is required to be a square, that is, a right angle, with respect to the flight direction (a).

Figure 11:
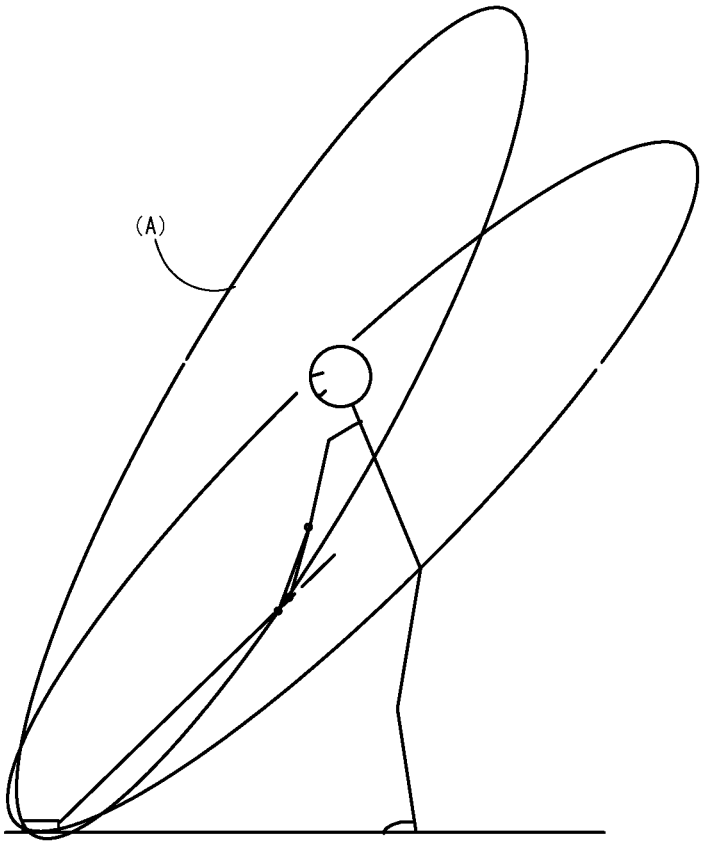
FIG. 11 is a diagram illustrating a circle (swing plane) obtained by drawing a club head trajectory in a front view.

The club head trajectory is not limited to the basic inside-in (1), but also includes golf swings such as an outside-in (2) and an inside-out (3) shown in FIG. 10. Furthermore, the club head trajectory in the front view includes various golf swings such as an upright swing (A) in which a circle (swing plane) obtained by drawing the club head trajectory in the front view shown in FIG. 11 is nearly vertical to the ground.

Even in such a wide variety of golf swings, the orientation of the club face at the impact point (b) is required to be square with respect to the flight direction (a). However, in the golf club, the shaft is bent like a whip during the swing, and the club head moves later than the grip in the downswing, and as a result, the club face tends to be opened. Furthermore, there is a phenomenon that the club head overtakes the grip and becomes reversely bent from the middle of the swing, and the club head and the grip do not move in the same way. Therefore, it is necessary to control the club face with the grip, such as by turning the hand early when such phenomenon is noticed and positively closing the club face.

Furthermore, the control against the club face is important even for the swing that seeks to increase the flight distance by positively performing face rotation for turning to the right around the shaft as an axis and then turning to the left through the follow through during the golf swing.

As described above, since it is important to always be aware of the orientation of the club face during the golf swing, the golf swing training tool 1 according to the present embodiment has effects that the golfer can have the swing feeling indoors as the use of a golf club while the orientation of the club face can be visually confirmed during the golf swing, and the golfer can train without any fear the drastic golf swing since it is safe even if the weight part 3 which is made of an elastic material comes into contact with the golfer's body.

Second Embodiment

Figure 2:
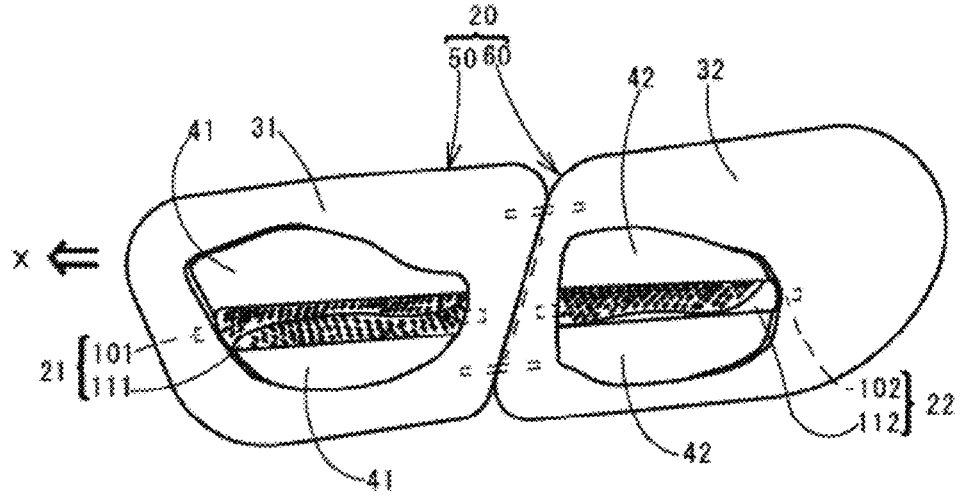
FIG. 2 is a front view illustrating a golf swing training tool according to a second embodiment of the present invention.
Figure 3:
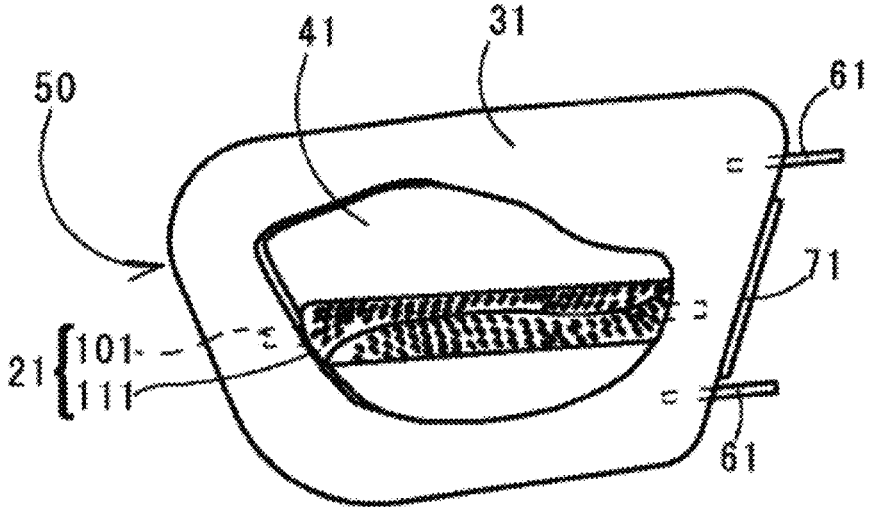
FIG. 3 is a front view illustrating a single-handed unit of the golf swing training tool according to FIG. 2.
Figure 4:
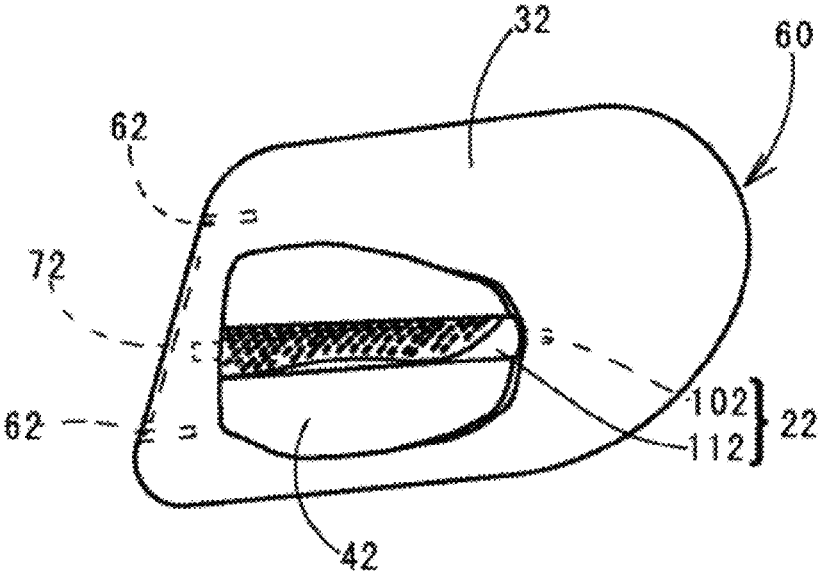
FIG. 4 is a front view illustrating the other single-handed unit of the golf swing training tool according to FIG. 2, which is different from the single-handed unit shown in FIG. 3.

As shown in FIGS. 2, 3 and 4, the golf swing training tool 20 according to the present embodiment is formed by detachably connecting a single-handed unit 50 including a grasping part 21 and a weight part 31 with a single-handed unit 60 including a grasping part 22 and a weight part 32.

The single-handed unit 50 and the single-handed unit 60 are detachably connected in a direction in which the grasping part 21 and the grasping part 22 are continuous. The connecting method is to connect in a detachable manner using the fitting between a fitting pin 61 and a fitting hole 62 and the connecting members 71 and 72. The connecting members 71 and 72 may be a combination of a ferromagnetic member and a magnet, or may use surface fastener members.

The weight part 31 is formed by chamfering in a curved manner four corners having a substantially trapezoidal shape in the front view whose lower surface is narrower than upper surface, and the weight part 32 is formed by chamfering, among the four corners having substantially rectangular shape in the front view, two adjacent corners into one curve and chamfering the remaining two corners independently in a curved manner.

The insertion holes 41 and 42 are formed with a required gap that allows one hand of a golfer to be inserted.

The materials and manufacturing methods of the weight parts 31 and 32 and the grasping parts 21 and 22, the mounting methods of the grasping parts 21 and 22 on the weight parts 31 and 32 and the like are the same as those in the first embodiment.

A method of using the golf swing training tool 20 according to the present embodiment is described below.

In the connecting state as shown in FIG. 2, a right-handed golfer may grasp a proximal grip part 111 with the left hand, and grasp a front grip part 112 with the right hand to perform a golf swing.

Figure 6:
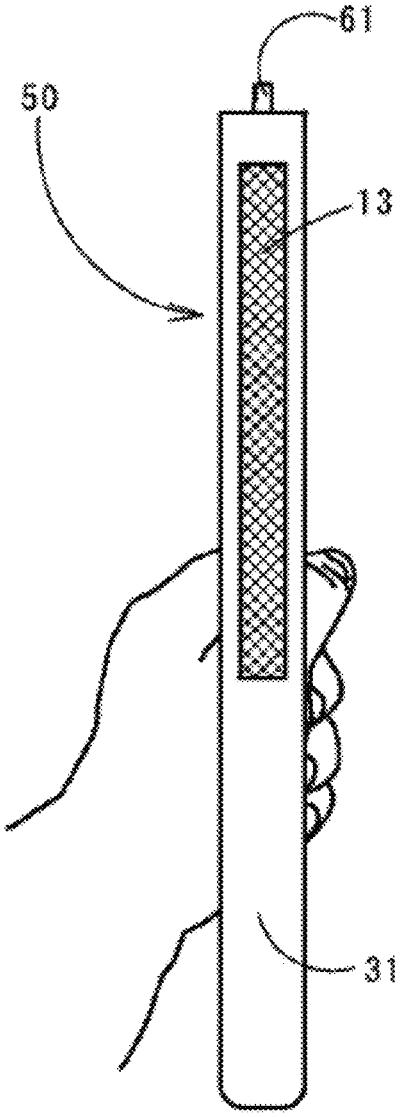
FIG. 6 is a plan view illustrating a usage state of the single-handed unit according to FIG. 3.
Figure 7:
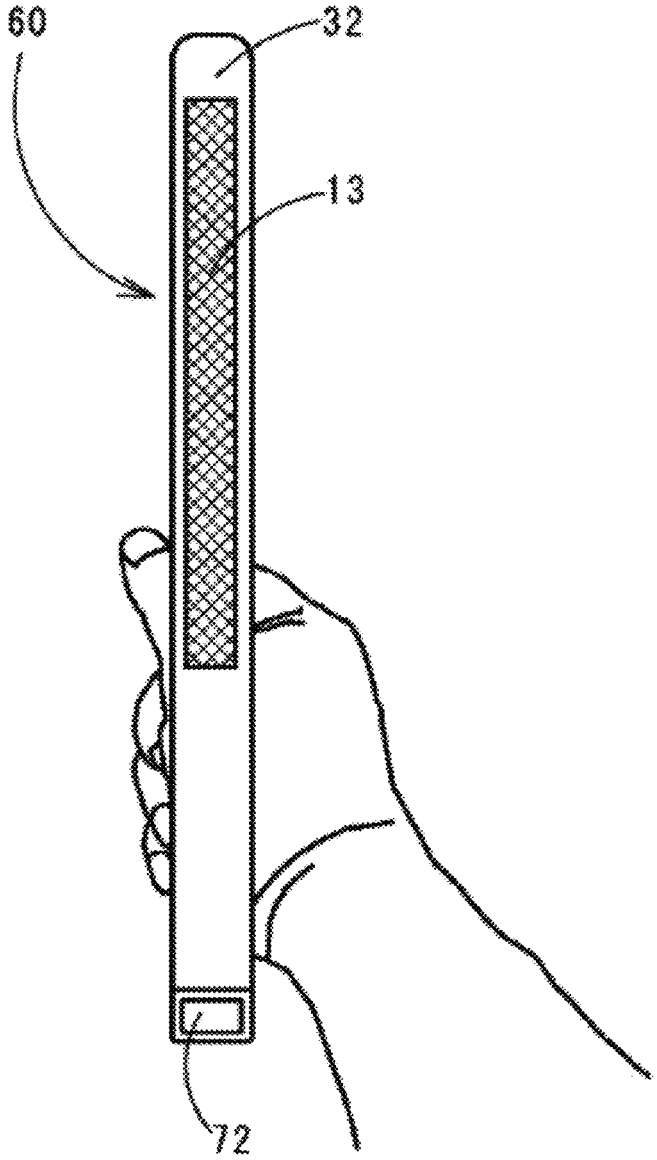
FIG. 7 is a plan view illustrating a usage state of the single-handed unit according to FIG. 4.

Furthermore, as shown in FIG. 6 or 7, when the single-handed units 50 and 60 are separately used, the golfer may grasp the grip parts 111 and 112 each with one hand to perform the golf swing with one hand.

The present embodiment has an effect that it is possible to confirm the respective movements of the right hand and the left hand when the single-handed units 50 and 60 are separately used. On the other hand, since when used in the connecting state, the single-handed units 50 and 60 are grasped slightly apart from each other with the right hand and the left hand with respect to the case of the golf club, and the front grip 112 moves farther away from the golfer than the proximal grip 111 during the swing with the golfer as the center, the golfer can experience the correct takeback using the shoulders as he/she can derive the motion of turning the shoulders greatly, and furthermore, there is also an effect of experiencing the turn of the hand as the front grip 112 has a motion of overtaking the proximal grip 111 after the impact.

Third Embodiment

Figure 9:
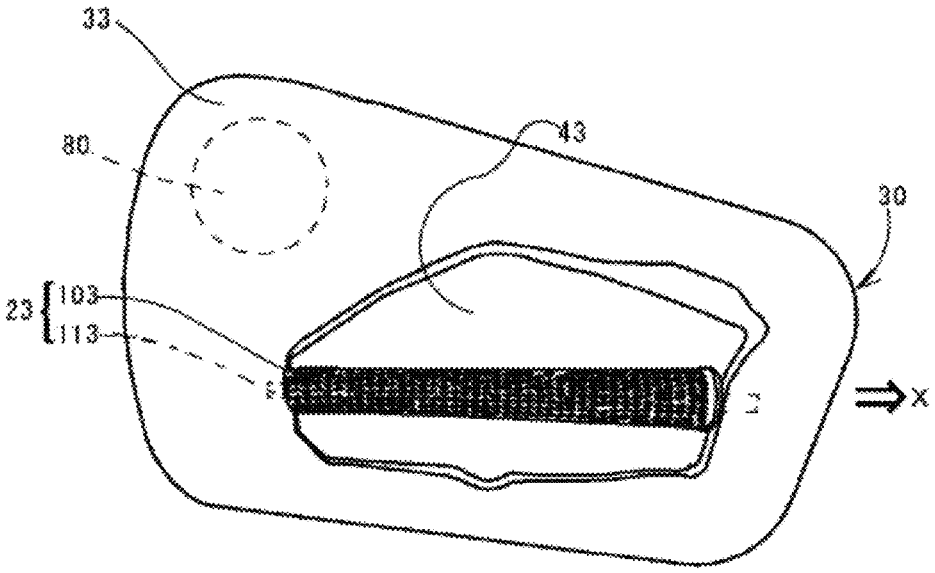
FIG. 9 is a front view illustrating a golf swing training tool according to a third embodiment of the present invention.

As shown in FIG. 9, a golf swing training tool 30 according to the present embodiment is formed by including, in a weight part 33, an adjusting member 80 which has a specific gravity different from that of rubber or elastomer, such as iron or non-ferrous metal.

In addition, the materials and manufacturing methods of the weight part 33 and a grasping part 23, the method of mounting the grasping part 23 on the weight part 33 and the like are the same as those in the first embodiment.

The present embodiment has an effect that it is possible to adjust the balance distribution in the materials with different specific gravities by using the adjusting member 80 for approximating the weight balance approximately the same as that of the golf club.

EXAMPLES

The examples of the present invention are described below, but the present invention is not limited to the following examples and may be appropriately modified and implemented without departing from the gist of the invention.

In order to implement the golf swing training tool 1 of the present invention, the dimensions of the respective parts shown in FIGS. 1 and 5 are set as follows.

Specifically, the total length L1 of the weight part 3 is 37 cm, the total height T is 21 cm, and the width W is 2 cm. Moreover, the total length L2 of the grip part 11 is 19 cm.

Furthermore, the overall weight of the golf club is about 400 g to 500 g, whereas the golf swing training tool 1 is about 1100 g. The weight distribution is approximately equal to that of the golf club, that is, the weight of a part above the grasping part 2 is formed to be ⅔ of the total weight.

Regarding the materials, the weight part 3 is made of a plate material of synthetic rubber, the shaft part 10 is formed by cutting a metal shaft of the golf club to a length of about 24 cm, and the grip part 11 is also formed by cutting a rear end of a grip for the golf club.

Since the golf swing training tool 1 of the present embodiment is set to have a weight approximately twice that of the golf club, there is an effect that the golfer can feel the movements of his/her body more easily as compared with the golf club, such as which muscles are used, which joints are moving in what manner, and the like.

As described above, the best configuration, method, etc. for carrying out the present invention have been disclosed in the above description, but the present invention is not limited to those.

For example, in the above-described embodiments and examples, the weight part is made of an elastic material such as rubber or elastomer, but the present invention is not limited thereto, and the weight part may be made of a resin composition such as plastic.

Furthermore, in the above-described embodiments and examples, the weight part is formed by chamfering in a curved manner the four corners having the substantially rectangular shape in the front view or the substantially trapezoidal shape in the front view, but the present invention is not limited thereto, and the shape of the corner is not particularly limited, and for example, may be an elliptical shape or a circle shape.

EXPLANATION OF REFERENCE NUMERALS

1, 20, 30 golf swing training tool
2, 21, 22, 23 grasping part
3, 31, 32, 33 weight part
4, 41, 42, 43 insertion holes
7 inner peripheral edge
8 border part
9 inner wall
10, 101, 102, 103 shaft part
11, 111, 112, 113 grip part
13 indication part
50, 60 single-handed part
61 fitting pin
62 fitting hole
71, 72 connecting member
80 adjusting member
X grip end side

The invention claimed is:

1. A golf swing training tool, comprising:
a grasping part made of a rod-shaped member;
a weight part made of a plate-shaped member for surrounding both ends of the grasping part; and
an insertion hole having a required gap to allow to grasp the grasping part between the grasping part and the weight part, wherein
the grasping part comprises a hollow tubular shaft part and a grip part which covers the shaft part,
both ends of the shaft part are embedded at required positions in a substantially central part in a thickness direction of an inner wall of the insertion hole,
the grasping part is not arranged at a weight center of the weight part, and
in a use state, positions of the both ends of the shaft part are relatively immovable with respect to the weight part.

2. The golf swing training tool according to claim 1, wherein
the weight part has an indication indicating the orientation of a club face.

3. The golf swing training tool according to claim 1, wherein
the grasping part is detachably arranged in an inner wall of the weight part, and is formed by a hollow tubular shaft part made of metal or fiber reinforced resin, and the grip part is made of an elastic material.

4. The golf swing training tool according to claim 1, wherein
the grasping part and the weight part are formed such that two single-handed units each to be grasped by one hand are disposed in series.

5. The golf swing training device according to claim 4, wherein
the single-handed units are connected to each other in a detachable manner.

6. The golf swing training tool according to claim 1, wherein
the weight part is made of an elastic material.

7. The golf swing training tool according to claim 1, wherein
the weight part includes a material having a specific gravity different from that of rubber or elastomer.

8. A golf swing training tool, comprising:
a main body;
a grasping part made of a rod-shaped member;
a weight part made of a plate-shaped member for surrounding both ends of the grasping part; and
an insertion hole having a required gap to allow to grasp the grasping part between the grasping part and the weight part, wherein
the grasping part comprises a hollow tubular shaft part and a grip part which covers the shaft part,
both ends of the shaft part are embedded at required positions in a substantially central part in a thickness direction of an inner wall of the insertion hole,
the grasping part is not arranged at a weight center of the weight part, and
in a use state, positions of the both ends of the shaft part are relatively immovable with respect to the main body.

* * * * *